United States Patent [19]

Smith

[11] 4,030,824

[45] June 21, 1977

[54] REPRODUCING APPARATUS HAVING AN IMPROVED IMAGING SURFACE CLEANING SYSTEM

[75] Inventor: Richard S. Smith, Fairport, N.Y.

[73] Assignee: Xerox Corporation, Stamford, Conn.

[22] Filed: Nov. 3, 1975

[21] Appl. No.: 628,183

[52] U.S. Cl. ..... 355/15; 15/1.5 R; 15/256.51; 15/256.52

[51] Int. Cl.[2] ..... G03G 21/00

[58] Field of Search ..... 355/15; 15/1.5, 256.51, 15/256.52

[56] References Cited

UNITED STATES PATENTS

| | | | |
|---|---|---|---|
| 3,634,077 | 1/1972 | Sullivan | 355/15 |
| 3,660,863 | 5/1972 | Gerbasi | 355/15 |
| 3,784,297 | 1/1974 | Ito | 355/15 |
| 3,883,242 | 5/1975 | Tarahashi | 355/3 |

*Primary Examiner*—Monroe H. Hayes
*Attorney, Agent, or Firm*—James J. Ralabate; Michael H. Shanahan; Paul Weinstein

[57] ABSTRACT

A reproducing apparatus including an imaging surface. A first frame supports a cleaning system for removing residual material from the imaging surface. A second frame supports a remote sump for storing the residual material removed by the cleaning system. The residual material is transported from the cleaning system to the remote sump through a selectively connectable conduit. One of the frames is supported for movement relative to the other between a first position wherein the conduit is connected between the cleaning system and the sump, and a second position wherein the conduit is disconnected. Preferably, a valve is provided in the conduit which is responsive to the movement of the frame for selectively sealing off the conduit when it is disconnected.

6 Claims, 6 Drawing Figures

REPRODUCING APPARATUS HAVING AN IMPROVED IMAGING SURFACE CLEANING SYSTEM

BACKGROUND OF THE INVENTION

This invention relates to an improved cleaning system for removing residual material such as toner from an imaging surface of a reproducing machine. The invention is particularly applicable to an electrostatographic reproducing machine.

A variety of cleaning systems are known and used commercially for removing residual material such as particulate toner from the surface of a reusable imaging member. One such cleaning system which has found particular application commercially is described in U.S. Pat. No. 3,740,789 to Ticknor. In the Ticknor patent, a resilient blade cleaning element is utilized to scrape toner off the surface of a photoconductive drum. The toner so removed is transported by a seal roll rearwardly toward a storage sump. A paddle wheel is utilized to push the toner into the fixed volume storage sump. The fixed volume sump limits the total number of copies which can be made with such an apparatus before maintenance is required to empty it. Therefore, it has been found desirable in accordance with the present invention to provide a sump remote from the cleaning system for storing the toner. By arranging the sump at a location remote from the cleaning system, larger sump volumes can be employed.

The use of sumps or toner collection bottles remotely located with respect to a cleaning system has found application with respect to brush cleaning systems. Note, for example, the system described in U.S. Pat. No. 3,793,986 to Latone.

It is also known in the art to provide a clam shell like frame arrangement for supporting the various sub-systems of a reproducing machine. In these types of system some of the sub-systems in the machine are supported in one frame and other sub-systems of the machine are supported in a second frame. The two frames are associated such that one of the frames is arranged to move relative to the other. In the Xerox 3100 copier, for example, the upper frame supports the xerographic drum, the developer system, the optical system, and the cleaning system, and the lower frame supports the paper feeder and registration system, a vacuum transport, a fuser, and an output tray. When the upper frame is pivoted away from the lower frame, the machine is opened in the manner of a clam shell to allow access to the paper path for the purposes of maintenance, etc.

U.S. Pat. No. 3,883,242 to Takahashi et al is illustrative of yet another approach utilizing a clam shell like frame arrangement. Various sub-systems of the machine are supported in one or the other frames forming the clam shell, and they can be separated to provide access to the internal parts of the machine.

A problem arises, however, when employing such a frame arrangement if the cleaning sub-system is supported in one frame, and the remote sump is supported in the other frame.

In accordance with this invention, a conduit is provided which is selectively connectable between the cleaning system and the sump. The conduit may be split apart when the frames are opened access to the inside of the machine. In accordance with a preferred embodiment of the present invention, a means is provided responsive to the opening of the frames for sealing off the conduit which extends from the cleaning system in order to prevent the escape of toner into the machine environment.

A variety of pipe of conduit couplings are known in the prior art. Some include automatic means for sealing off the conduits when they are disconnected and vice versa. For example, note the following U.S. Pat. Nos. 407,922 to Brown, Jr.; 584,144 to Gold; 599,603 to Froelich; 1,064,291 to Conrade; 1,096,278 to Sutton; 1,303,448 to Antonietti; 2,300,483 to Burger et al; 2,492,271 to Cox et al; 3,754,564 to Naumburg. It is also known to utilize valve arrangements in toner dispensers for development systems of xerographic reproducing machines. Note, for example, U.S. Pat. Nos. 3,472,657 to Mayer et al., and 3,698,926 to Furuichi.

SUMMARY OF THE INVENTION

In accordance with the present invention it has been found desirable to provide a reproducing apparatus including a plurality of frames with at least one of the frames arranged for movement relative to another of the frames. Various sub-systems in the machine are supported in one or the other of the frames. When the frames are moved to one position the machine is arranged to be operational for reproducing copies. When the frames are separated, access is provided to the internal portion of the machine for maintenance, etc.

In accordance with this invention the cleaning subsystem of the machine which serves to remove residual material such as toner from the surface of an imaging member is supported in one of the frames. A remote sump supported by the other of the frames is arranged to receive the residual material removed by the cleaning system and store it subject to periodic removal in accordance with conventional maintenance procedures. The use of a remote sump allows the sump capacity to be as large as desired to allow for an appropriate interval between maintenance calls.

In accordance with a preferred embodiment of this invention residual material from the cleaning system is transported to a selectively connectable conduit which communicates with the remote sump. When the frames are arranged in their closed position the conduit is connected to form a continuous closed path between the cleaning system and the remote sump. When the frames are separated to provide access, the conduit is disconnected. Preferably, in accordance with this invention, a valve means is provided responsive to the separation of the frames for sealing the conduit when it is disconnected between the cleaning system and the sump in order to prevent the escape of residual material into the machine environment.

Preferably, in accordance with this invention, the first frame comprises an upper frame and supports the cleaning system, and the second frame comprises a lower frame and supports the remote sump.

The cleaning system of the present invention preferably employs a blade cleaning member for removing the residual material from the surface of a photoconductive member, and the transporting means includes an auger which receives the material removed by the blade and transports it to one side of the cleaning system. The conduit is arranged in communication with the auger and the residual toner is allowed to fall through the conduit by gravity into the remote sump. The conduit is arranged to be split into two sections upon the separation of the first and second frames.

The provision of a cleaning system supported by one frame and a remote sump supported in a separate frame allows for an extremely compact reproducing apparatus to be provided and at the same time, it allows an enlarged sump capacity to be provided to extend intervals between maintenance calls.

Accordingly, it is an object of the present invention to provide a reproducing apparatus having an improved cleaning system.

It is a further object of this invention to provide an apparatus as above having a sump remote from the cleaning system for storing material removed by the cleaning system.

It is still further object of this invention to provide an apparatus as above wherein the cleaning system and the sump are supported by separate frames movable relative to one another.

These and other objects will become more apparent from the following drawings and description.

DETAILED DESCRIPTION OF THE PREFERRED EMBODIMENTS

Figure 1:
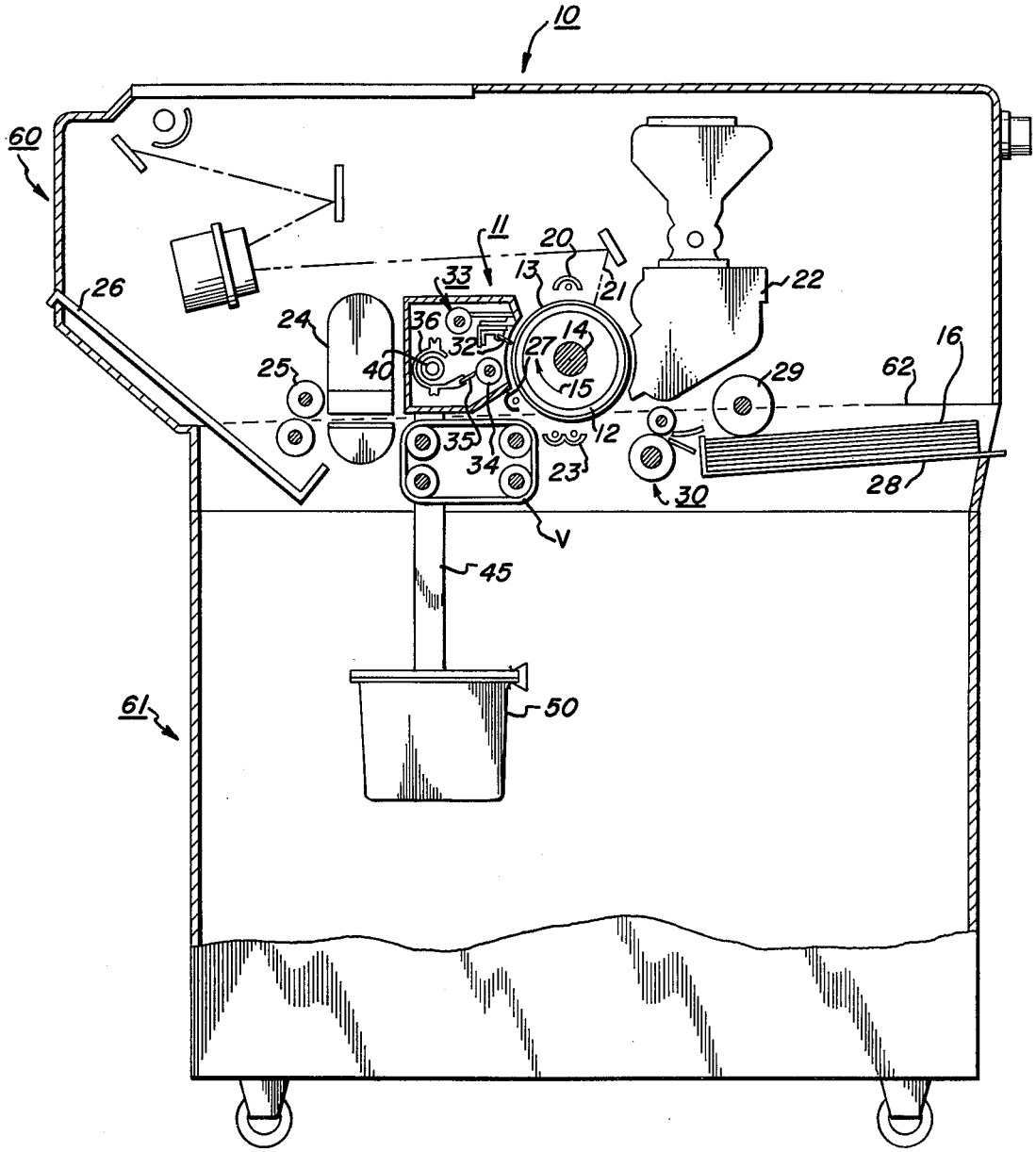
FIG. 1 is a schematic front view of a reproducing apparatus in accordance with this invention.

Referring now to FIg. 1 there is shown by way of example an electrostatographic reproducing machine 10 which incorporates the improved cleaning apparatus 11 of the present invention. The reproducing machine 10 depicted in FIG. 1 illustrates the various components utilized therein for xerographically producing copies from an original. Although the cleaning apparatus of the present invention is particularly well adapted for use in an automatic xerographic reproducing machine 10, it should become evident from the following description that it is equally well suited for use in a wide variety of electrostatographic systems and is not necessarily limited in its application to the particular embodiment shown herein.

The reproducing machine illustrated in FIG. 1 employs an image recording drum-like member 12, the outer periphery of which is coated with a suitable photoconductive material 13. One type of suitable photoconductive material is disclosed in U.S. Pat. No. 2,970,906, to Bixby. The drum 12 is suitably journaled for rotation within a machine frame (not shown) by means of a shaft 14 and rotates in the direction indicated by arrow 15, to bring the image retaining surface thereon past a plurality of xerographic processing stations or sub-systems. Suitable drive means (not shown) are provided to power and coordinate the motion of the various cooperating machine components whereby a faithful reproduction of the original input scene information is recorded upon a sheet 16 of final support material such as paper or the like.

The practice of xerography is well-known in the art, and is the subject of numerous patents and texts, including *Electrophotography* by Schaffert, published in 1965, and *Xerography and Related Processes*, by Dessauer and Clark, published in 1965. Initially the drum 12 moves photoconductive surface 13 through charging station 20. In charging station 20 an electrostatic charge is placed uniformly over the photoconductive surface 13 preparatory to imaging. The charging may be provided by corona generating device of a type described in U.S. Pat. No. 2,836,725, to Vyverberg.

Thereafter, the drum 12 is rotated to exposure station 21 where the charged photoconductive surface 13 is exposed to a light image of the original input scene information, whereby the charge is selectively dissipated in the light exposed regions to record the original input scene in the form of a latent electrostatic image. A suitable exposure system may be of the type described in U.S. Pat. No. 3,832,057 to Shogren.

After exposure, drum 12 rotates the electrostatic latent image recorded on the photoconductive surface 13 to development station 22 wherein a conventional developer mix is applied to the photoconductive surface 13 rendering the latent image visible. A suitable development station is disclosed in U.S. Pat. No. 3,707,947 to Reichart. The patent describes a magnetic brush development system utilizing a magnetizable developer mix having carrier granules and a toner colorent. The developer mix is continuously brought through a directional flux field to form a brush thereof. The electrostatic latent image recorded on photoconductive surface 13 is developed by bringing the brush of developer mix into contact therewith.

The developed image on the photoconductive surface 13 is then brought into contact with a sheet 16 of final support material within a transfer station 23 and the toner image is transferred from the photoconductive surface 13 to the contacting side of the final support sheet 16. The final support material may be paper, plastic, etc., as desired. After the toner image has been transferred to the sheet of final support material 16 the sheet with the image thereon is advanced to a suitable fuser 24 which coalesces the transferred powder image thereto. One type of suitable fuser is described in U.S. Pat. No. 2,701,765, to Codichini, et al. After the fusing process the sheet 16 is advanced by rolls 25 to catch tray 26 for subsequent removal therefrom by the machine operator.

Although a preponderance of the toner powder is transferred to the final support material 16, invariably some residual toner remains on the photoconductive surface 13 after the transfer of toner powder image to the final support material. The residual toner particles remaining on the photoconductive surface 13 after the transfer operation are removed from the drum 12 as it moves through cleaning station 11 of this invention. Here the residual toner particles are first brought under the influence of a cleaning corona generating device 27 adapted to neutralize the electrostatic charge remaining on the toner particles. The neutralized toner particles are then mechanically cleaned from the photoconductive surface 13 by conventional means as, for example, the use of a resiliently biased knife blade as set forth in U.S. Pat. No. 3,740,789 to Ticknor.

A paper cassette 28 is preferably provided with an adjustable feature whereby sheets of varying length and width can be conveniently accommodated therein. In operation the cassette 28 is filled with a stack of final support material of pre-selected size and the cassette is inserted into the machine in operable relationship with a pair of feed rolls 29. When properly positioned in communication with the feed rolls 29 the top most sheet of the stack is separated and forwarded from the stack into the transfer station 23 by means of registration rolls 30.

It is believed that the foregoing description is sufficient for purposes of the present application to illustrate the general operation of an automatic xerographic copier 1 which can embody the teachings of the present invention.

Having thus described a reproducing apparatus 10 which may include the improved cleaning system 11 of the present invention attention will now be directed to the details of that cleaning system.

Referring still to FIG. 1, the cleaning system uses a flexible blade 32 of polymeric material having an edge which engages the surface 13 of the photoconductive drum 12 to scrape the residual toner off the drum. The blade cleaning system shown is similar in many respects to that described in the aforenoted Ticknor patent. It may be translated by a translation mechanism 33 such as that described in the Ticknor patent. A seal roll 34 may be the same as the one described in the Ticknor patent or alternatively, it could be an electrostatic type seal roll as described in U.S. Pat. No. 3,634,077 to Sullivan. A polymeric blade 35 scrapes the toner off the seal roll 35 which then slides into the auger cavity defined by the extrusion 36. An auger 40 is supported within the extrusion 36 and transports the toner to the side of the cleaning system 11 which is at the rear of the machine 10. The machine 10 in FIG. 1 is viewed from the front.

Figure 2:
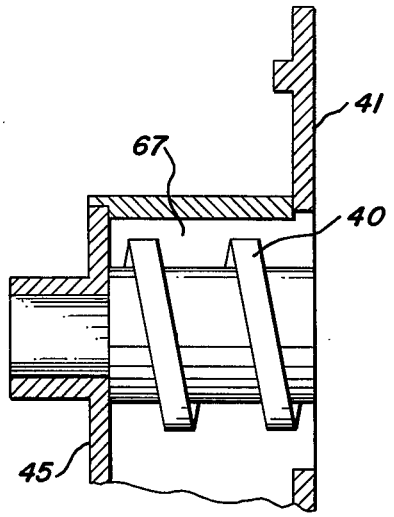
FIG. 2 is a partial cross-sectional view showing the downstream end of the auger in the cleaning system in the machine of FIG. 1.

Referring to FIGS. 1 and 2, rotation of the auger 40 transports the toner through the rear side plate 41 of the cleaning system 11 and into communication with a conduit 45. The toner then falls by gravity through the conduit 45 into a remote sump 50 of any desired capacity wherein it is stored subject to periodic removal upon routine maintenance of the machine 10.

Figure 3:
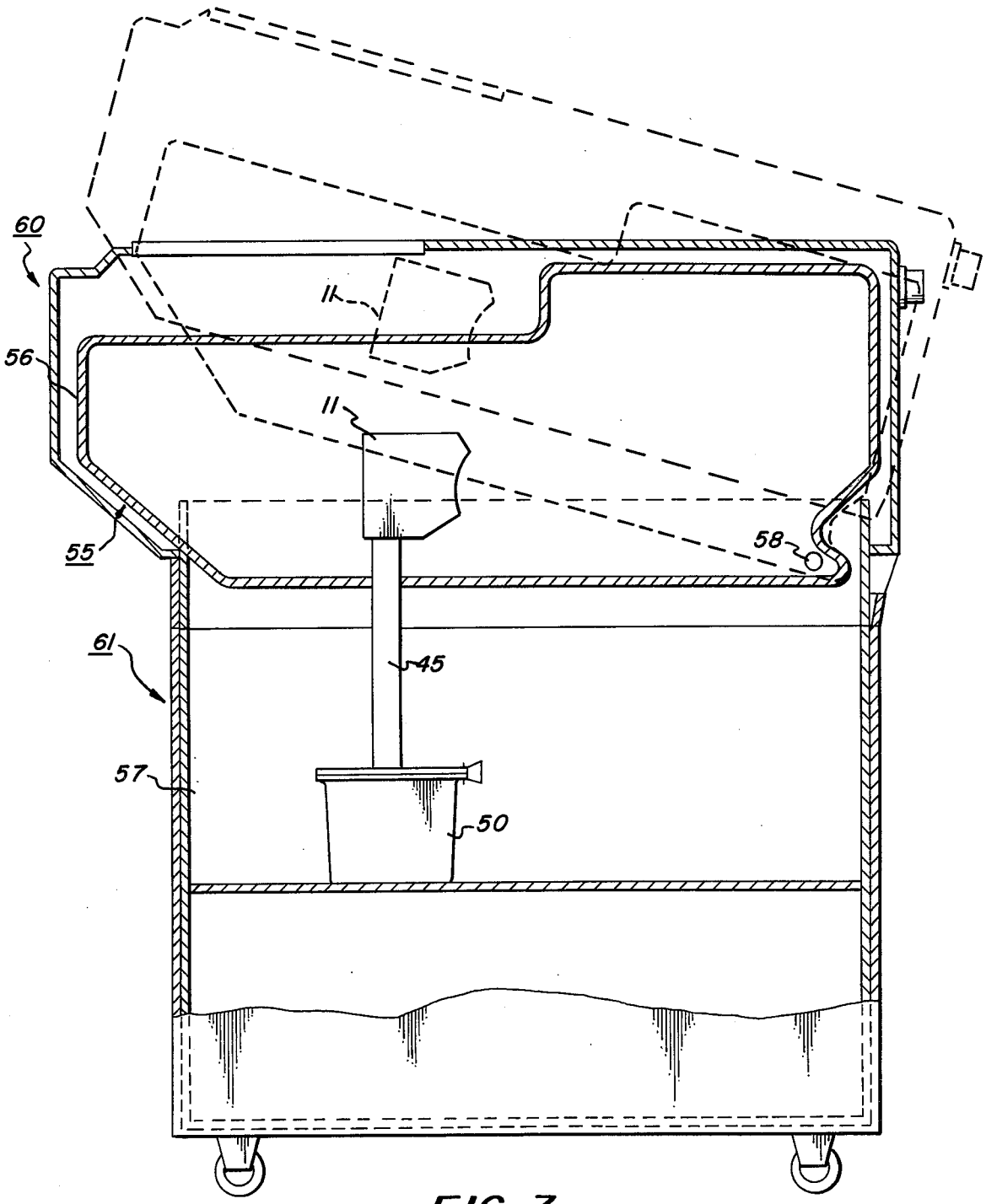
FIG. 3 is a partial schematic front view of the machine of FIG. 1 illustrating the frames arrangement for supporting the cleaning system and remote sump.

Referring now to FIG. 3, a partial schematic drawing of the reproducing machine 10 in FIG. 1 is shown which illustrates the frame arrangement 55 for supporting the cleaning system 11 and remote sump 50 in accordance with a preferred embodiment of the present invention. A clam shell like frame arrangement 55 is provided including an upper frame 56 and a lower frame 57. The upper frame 56 is pivotally supported at 58 with respect to lower frame 57. The frames may be separated or opened as shown in phantom in the manner of a clam shell to provide access to the internal portions of the machine or they may be closed as shown in solid lines when the machine is to be operational for producing copies.

In the apparatus of FIG. 3 the frames 56 and 57 which are shown are the rear frames. The front frames and side frames are not shown for purposes of clarity. The front frames would be substantially the same as the rear frames and the side frames could comprise braces extending between the front and rear frames. The upper frame 56 is arranged to be partially nested within the lower frame 57 so that when the frames are in their closed position, there is an overlap. This overlap is desirable since it allows flexibility in deciding which sub-systems of the machine will be supported by the upper frame or the lower frame. The upper and lower frames 56 and 57 and the sub-systems supported by them serve to divide the machine into upper and lower portions 60 and 61 parting along line 62 as in FIG. 1.

It is apparent that the cleaning system 11 of the present invention is supported in the upper frame 56 and the remote sump 50 is supported in the lower frame 57. When the frames are closed, the cleaning system 11 is connected to the remote sump by means of a selectively connectable conduit 45. When the frames are opened the cleaning system separates from the lower portion of the conduit.

The other sub-systems or processing stations of the machine may be supported within the upper and lower frames as desired. In the Xerox 3100 Copier as an example, the xerographic drum 12, the development system 22, the cleaning system 11, and the optical system 21, are supported by the upper frame 56, whereas the paper feeder 29, the registration rolls 30, the vacuum transport V, and the fuser 24, are supported by the lower frames 57. Such an arrangement comprises a preferred embodiment in accordance with the present invention. The sub-systems in the machine other than the cleaning system 11 have not been shown in FIG. 3 for purposes of clarity. The sub-systems may be supported in the frames by any desired conventional means.

Figure 4:
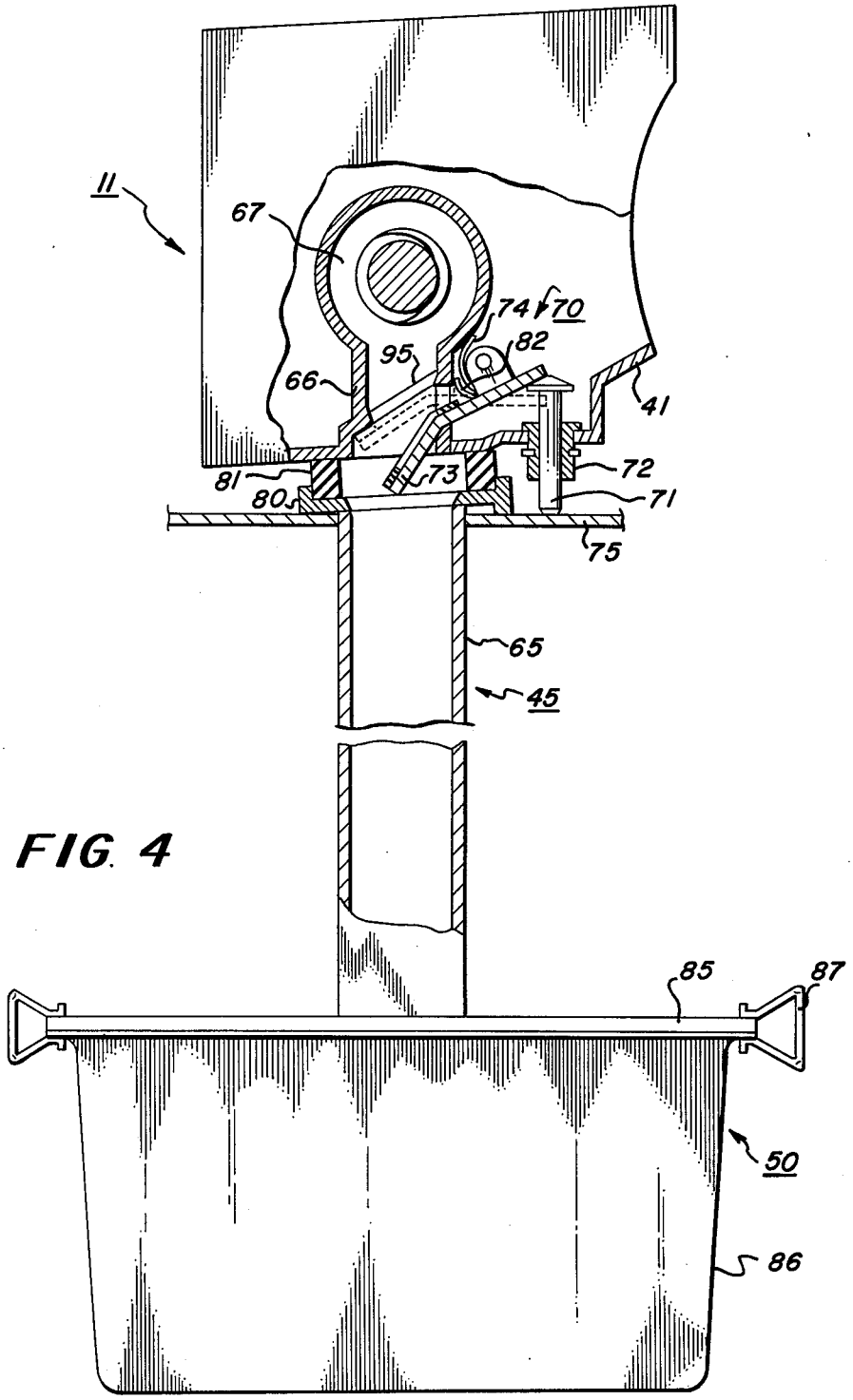
FIG. 4 is a partial cross-sectional view of the cleaning system and remote sump of this invention in their operative positions.

Referring now to FIG. 4, the cleaning system and remote sump 50 of the present invention will be described in greater detail. The arrangement shown occurs when the frames 56 and 57 are in their closed position such that the machine is operational to make copies. The cleaning system 11 in FIG. 4 is being viewed from the back of the machine toward the front, and is, therefore, reversed as compared to that shown in FIGS. 1 and 2.

The conduit 45 has a rectangular cross section and is selectively connectable between the cleaning system 11 and the remote sump 50. Selectively connectable is intended to mean that the conduit may be either split into two sections 65 and 66 as shown or alternatively that it may be separated from one or the other of the sump 50 and cleaning system 11. The upper portion 66 of the conduit 45 includes a chamber 67 wherein the downstream end of the auger 40 is supported to provide communication between the cleaning auger and the conduit. The residual toner falls by gravity from the cleaning auger through the connected conduit 45 and into the sump 50. The auger chamber 67 and upper conduit portion 66 are shown as an integral section, and are supported by side 41 of the cleaning housing.

A valve 70 is provided for sealing the upper portion 66 of the conduit 45 when the cleaning system and sump supporting frames 56 and 57 are separated apart, thereby separating the cleaning system from the lower conduit portion 65 and sump. The valve 70 is arranged to be actuable automatically in response to the opening or closing of the frames 56 and 57 which in turn connects or disconnects the upper and lower conduit portions 65 and 66.

A pin 71 is supported by the cleaning system housing 41 in a freely sliding arrangement by means of a Teflon bushing 72. A valve member 73 comprises a plate-like member which is pivotally supported by the cleaning system housing. The valve member is normally biased by means of a spring 74 to its closed position as shown in phantom.

The rear portion of the valve member 73 engages a cone-like end of the pin 71. The other end of the pin is arranged to selectively engage a member 75 which is associated with the lower frames 57 or lower conduit portion 65. The valve member is pivoted to its open position against the bias of the spring 74 when the cleaning system support frame 56 is closed with respect to the sump system support frame 57 and the upper and lower conduit portions are connected. In this case the pin 71 engages the member 75 supported by the lower frame to push the valve 73 about its pivot into its open position shown in solid lines. Therefore, when the conduit 45 is connected in its operative position, the pin is operated upon by member 75 to automatically open the valve to allow the toner to free fall from the auger into the sump. While a valve 70 has been shown only for the upper conduit portion 66, if desired, one could be employed in the lower portion 65 as well. A valve 70 for the lower portion is not essential, however, since gravity would oppose the escape of toner therefrom when the machine is open.

The lower conduit portion 65 ends in an adapter member 80 which serves to provide a mating incline with respect to the upper conduit portion 66. A resilient gasket 81 secured to the adapter member 80 provides a seal between the upper and lower conduit portions when they are connected.

The valve member 73 also includes a flexible seal element 82 for substantially closing the hole in the sidewall of the conduit 66 which is required to allow for the pivotal motion of the valve plate 73.

Figure 5:
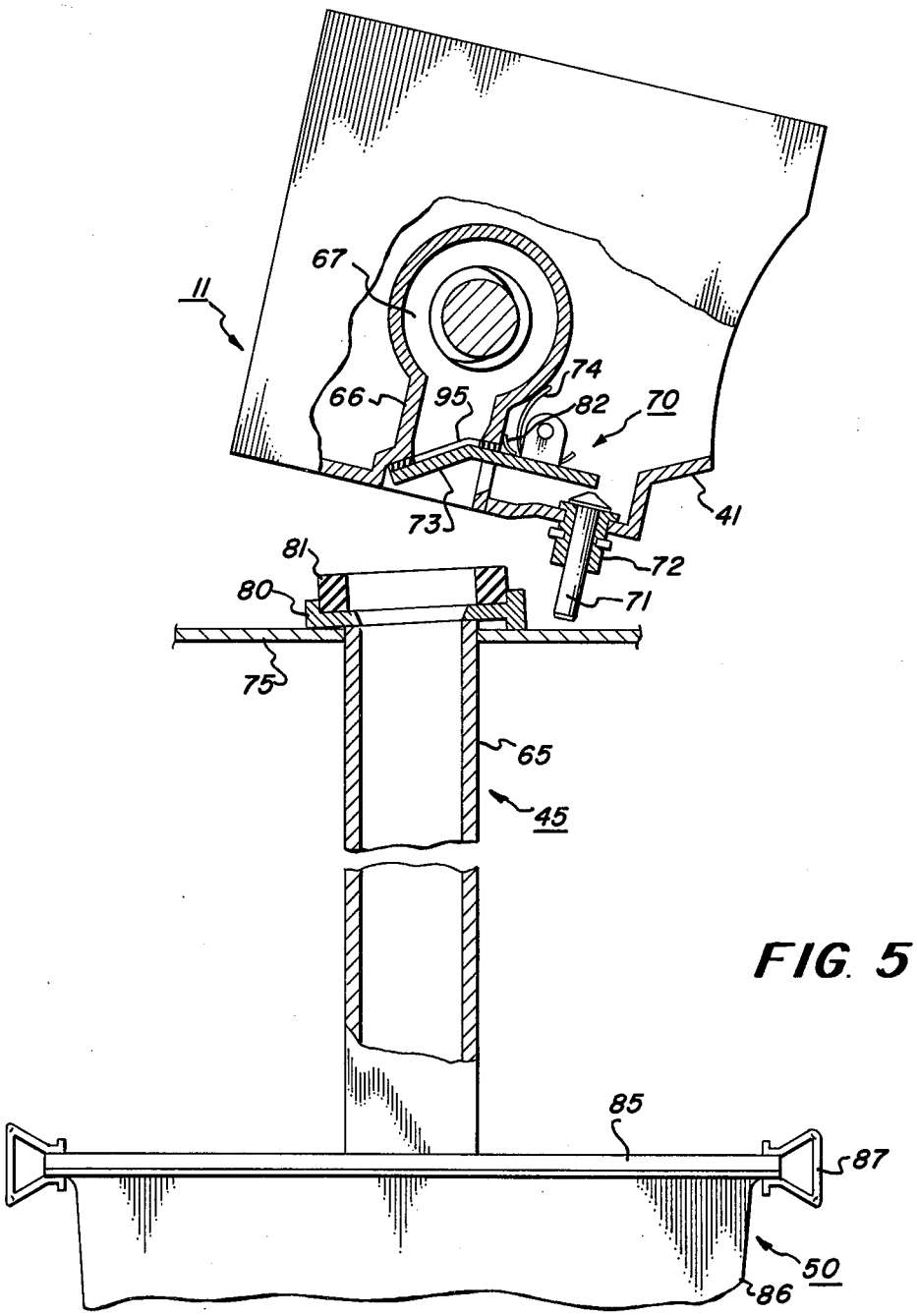
FIG. 5 is a partial cross-sectional view of the cleaning system and remote sump of this invention in their inoperative separated positions.

Referring to FIG. 5, the apparatus of this invention is shown in its inoperative state wherein the cleaning system 11 has been separated from the remote sump 50 by movement of the upper frame 56 away from the lower frame 57. The upper conduit portion 66 has been disconnected from the lower conduit portion 65. When the conduit portions are disconnected, as shown, the pin 71 no longer engages the member 75 supported by the lower frames 57 so that the valve plate 73 pivots into its operative position under the bias imparted by spring 74 to seal off the upper conduit portion 66. The valve plate 73 also acts to push the pin 71 to its extended position.

The lower conduit portion 65 is connected to the remote sump cover flange 85. A pan-like member 86 is secured to the flange by means of spring clips 87 to provide the remote sump 50. The pan 86 may be easily removed from the machine for emptying by merely removing the clips 87. Alternatively, if desired, the remote sump could comprise a toner removed by the cleaning system could be reused in the reproducing apparatus.

Figure 6:
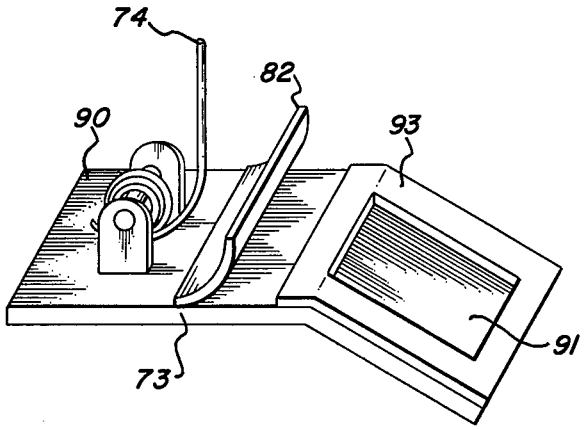
FIG. 6 is a perspective view of a conduit valve in accordance with this invention.

Referring to FIG. 6, the valve plate 73 is shown in greater detail. The valve plate includes a first substantially planar portion 90 and a second substantially planar portion 91 inclined to the first portion, A rectangular foam gasket 93 is arranged to provide sealing engagement between the valve plate and the conduit valve seat 95 as in FIGS. 4 and 5. The valve seat 95 is in the upper portion 66 of the conduit and is arranged to mate with the valve plate.

The inclined valve seat 95 and valve plate 73 reduces the amount of motion required for the valve plate to provide a sufficient opening for the toner to fall through. The use of a conduit with a rectangular cross-section is preferred in order to allow a plate-like valve member to be employed.

The patents, patent applications, and texts specifically set forth in this application are intended to be incorporated by reference into the description.

The term electrostatographic as employed in the present application refers to the formation and utilization of electrostatic charge patterns for the purpose of recording and reproducing patterns in viewable form.

It is apparent that there have been provided in accordance with this invention apparatuses which fully satisfy the objects, means and advantages set forth hereinbefore. While the invention has been described in conjunction with specific embodiments therefor, it is evident that many alternatives, modifications and variations will be apparent to those skilled in the art in light of the foregoing description. Accordingly, it is intended to embrace all such alternatives, modifications and variations as fall within the spirit and borad scope of the appended claims.

What is claimed is:

1. A reproducing apparatus comprising:

an imaging surface;

a first frame;

means for removing residual material from said imaging surface, said removing means being supported by said first frame;

a second frame;

means remote from said removing means for storing said residual material removed from said imaging surface by said removing means, said storing means being supported in said second frame;

means for transporting said residual material from said removing means to said storing means including selectively connectable conduit means extending between said removing means and said storing means;

means for supporting one of said frames for movement relative to the other of said frames between a first position wherein said conduit means is connected between said removing means and said storing means and a second position wherein said conduit means is disconnected between said removing means and said storing means; and whereby upon movement of said one frame to said second position, said conduit portions are disconnected and upon movement of said one frame to said first position said conduit portions are connected together.

2. An apparatus as in claim 1, further including selectively actuable valve means for sealing said conduit to prevent the escape of residual material therefrom, and means for actuating said valve means to seal said conduit in response to the movement of said one frame to said second position wherein said conduit is disconnected between said removing means and said storing means.

3. An apparatus as in claim 2, wherein said transporting means includes an auger associated with said removing means, said auger being arranged to transport said residual material to said conduit means, and wherein said conduit means is arranged between said auger and said remote storing means so that said residual material transported to it by said auger, free falls through said conduit into said storing means.

4. An apparatus as in claim 3, wherein said conduit means includes a first portion associated with said removing means and a second portion associated with said storing means.

5. An apparatus as in claim 4, wherein said valve means is supported in said first portion of said conduit means and said conduit means has a rectangular cross-section, said valve means comprising a plate-like member including a first planar portion and a second planar portion inclined with respect to said first planar portion, and wherein said conduit means includes an inclined valve seat for mating with said valve member, said valve member being pivotally supported, and further including means for biasing said valve member into a normally closed position to seal off said first portion of said conduit.

6. An apparatus as in claim 5, wherein said apparatus comprises an electrostatographic reproducing apparatus further including means for forming an electrostatic image on said imaging surface, means for developing said image to render it visible, and means for transferring said visible image to a sheet of final support material.

* * * * *